US006764288B1

(12) United States Patent
Liepert et al.

(10) Patent No.: US 6,764,288 B1
(45) Date of Patent: Jul. 20, 2004

(54) TWO STAGE SCROLL VACUUM PUMP

(75) Inventors: Anthony G. Liepert, Lincoln, MA (US); Jeffrey C. Warren, Westford, MA (US); Robert M. Curry, Jr., Arlington, MA (US)

(73) Assignee: Varian, Inc., Palo Alto, CA (US)

( * ) Notice: Subject to any disclaimer, the term of this patent is extended or adjusted under 35 U.S.C. 154(b) by 0 days.

(21) Appl. No.: 10/703,852

(22) Filed: Nov. 6, 2003

(51) Int. Cl.[7] ..... F04C 18/00

(52) U.S. Cl. ..... 418/55.5; 418/5; 418/6; 418/55.1

(58) Field of Search ..... 418/55.2, 5, 6, 418/55.1, 59

(56) References Cited

U.S. PATENT DOCUMENTS 4,157,234 A * 6/1979 Weaver et al. ..... 418/6
4,389,171 A 6/1983 Eber et al.
4,457,674 A * 7/1984 Kawano et al. ..... 418/5
4,477,238 A 10/1984 Terauchi
4,497,615 A 2/1985 Griffith
4,650,405 A 3/1987 Iwanami et al.
5,304,047 A 4/1994 Shibamoto
5,616,015 A 4/1997 Liepert
5,857,844 A * 1/1999 Lifson et al. ..... 418/55.2
6,050,792 A 4/2000 Shaffer

FOREIGN PATENT DOCUMENTS

JP 2002364561 A * 12/2002 ..... F04C/18/02

* cited by examiner

*Primary Examiner*—Trieu Theresa
*Assistant Examiner*—Theresa Trieu
(74) *Attorney, Agent, or Firm*—Wolf, Greenfield, Sacks; Bella Fishman

(57) ABSTRACT

Vacuum pumping apparatus includes a scroll set having an inlet and an outlet. The scroll set includes a first stationary scroll blade and a second stationary scroll blade extending from a stationary plate and separated by a gap, and an orbiting scroll extending from an orbiting plate, wherein the first and second stationary scroll blades are intermeshed with the orbiting scroll blade to define one or more interblade pockets. The vacuum pumping apparatus further includes a relief port in the gap between the first and second stationary scroll blades and coupled through a relief passage to an exhaust, a relief valve in the relief passage, and a drive mechanism operatively coupled to the orbiting scroll element for producing orbiting motion of the orbiting scroll blade relative to the first and second stationary scroll blades.

9 Claims, 4 Drawing Sheets

TWO STAGE SCROLL VACUUM PUMP

FIELD OF THE INVENTION

This invention relates to scroll-type vacuum pumps and, more particularly, to scroll-type vacuum pumps which have a two-stage design.

BACKGROUND OF THE INVENTION

Scroll devices are well known in the field of vacuum pumps and compressors. In a scroll device, a movable spiral blade orbits with respect to a fixed spiral blade within a housing. The movable spiral blade is connected to an eccentric drive mechanism. The configuration of the scroll blades and their relative motion traps one or more volumes or "pockets" of a fluid between the blades and moves the fluid through the device. Most applications apply rotary power to pump a fluid through the device. Oil-lubricated scroll devices are widely used as refrigerant compressors. Other applications include expanders, which operate in reverse from a compressor, and vacuum pumps. Scroll pumps have not been widely adopted for use as vacuum pumps, mainly because the cost of manufacturing a scroll pump is significantly higher than a comparably-sized, oil-lubricated vane pump. Dry scroll pumps have been used in applications where oil contamination is unacceptable.

A scroll pump includes stationary and orbiting scroll elements, and a drive mechanism. The stationary and orbiting scroll elements each include a scroll plate and a spiral scroll blade extending from the scroll plate. The scroll blades are intermeshed together to define interblade pockets. The drive mechanism produces orbiting motion of the orbiting scroll element relative to the stationary scroll element so as to cause the interblade pockets to move toward the pump outlet.

Various scroll pump designs have been proposed in the prior art to increase performance and to reduce pump size. A two stage scroll pump is disclosed in U.S. Pat. No. 5,616,015, issued Apr. 1, 1997 to Liepert. U.S. Pat. No. 4,650,405, issued Mar. 17, 1987 to Iwanami et al., discloses a scroll pump with axially-spaced pumping chambers in series. A double-sided first stage feeds a single-sided second stage. A scroll compressor having two stages on opposite sides of an orbiting plate is disclosed in U.S. Pat. No. 5,304,047, issued Apr. 19, 1994 to Shibamoto. A single-sided scroll compressor having scroll blades with portions of different axial heights is disclosed in U.S. Pat. No. 4,477,238, issued Oct. 16, 1984 to Terauchi. A multi-stage, single-sided scroll compressor is disclosed in U.S. Pat. No. 6,050,792, issued Apr. 18, 2000 to Shaffer. Scroll compressors having a relief valve in a passage which couples a moving volume between scroll blades to a discharge port are disclosed in U.S. Pat. No. 4,389,171 issued Jun. 21, 1983 to Eber et al. and U.S. Pat. No. 4,497,615 issued Feb. 5, 1985 to Griffith.

The prior art scroll pump designs have not been entirely satisfactory with respect to both performance and physical size. Accordingly, there is a need for improved scroll-type vacuum pumping apparatus.

SUMMARY OF THE INVENTION

According to a first aspect of the invention, vacuum pumping apparatus is provided. The vacuum pumping apparatus comprises a scroll set having an inlet and an outlet. The scroll set comprises a first stationary scroll blade and a second stationary scroll blade extending from a stationary plate and separated by a gap, and an orbiting scroll blade extending from an orbiting plate, wherein the first and second stationary scroll blades are intermeshed with the orbiting scroll blade to define one or more interblade pockets. The vacuum pumping apparatus further comprises a relief port in the gap between the first and second stationary scroll blades and coupled through a relief passage to an exhaust, a relief valve in the relief passage, and a drive mechanism operatively coupled to the orbiting plate for producing orbiting motion of the orbiting scroll blade relative to the first and second stationary scroll blades so as to cause the one or more interblade pockets to move toward the outlet.

The drive mechanism may include a motor having an axis of rotation. The first stationary scroll blade may have a first axial depth, and the second stationary scroll blade may have a second axial depth. The first axial depth may be greater than the second axial depth.

The first stationary scroll blade may define a first pumping stage and the second stationary scroll blade may define a second pumping stage. The first and second pumping stages may be coupled in series between the inlet and the outlet.

According to a second aspect of the invention, a scroll vacuum pump is provided. The scroll vacuum pump comprises a scroll set having an inlet, an outlet and first and second pumping stages coupled in series between the inlet and the outlet. The scroll set comprises a first stationary scroll blade and a second stationary scroll blade extending from a stationary plate, and a first orbiting scroll blade and a second orbiting scroll blade extending from an orbiting plate. The first stationary and orbiting scroll blades define the first pumping stage, the second stationary and orbiting scroll blades define the second pumping stage, and a gap is provided between the first and second stationary scroll blades. The scroll vacuum pump further comprises a relief port in the gap between the first and second stationary scroll blades and coupled through a relief passage to the outlet; a relief valve in the relief passage; and a drive mechanism operatively coupled to the orbiting plate for producing orbiting motion of the first and second orbiting scroll blades relative to the first and second stationary scroll blades.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
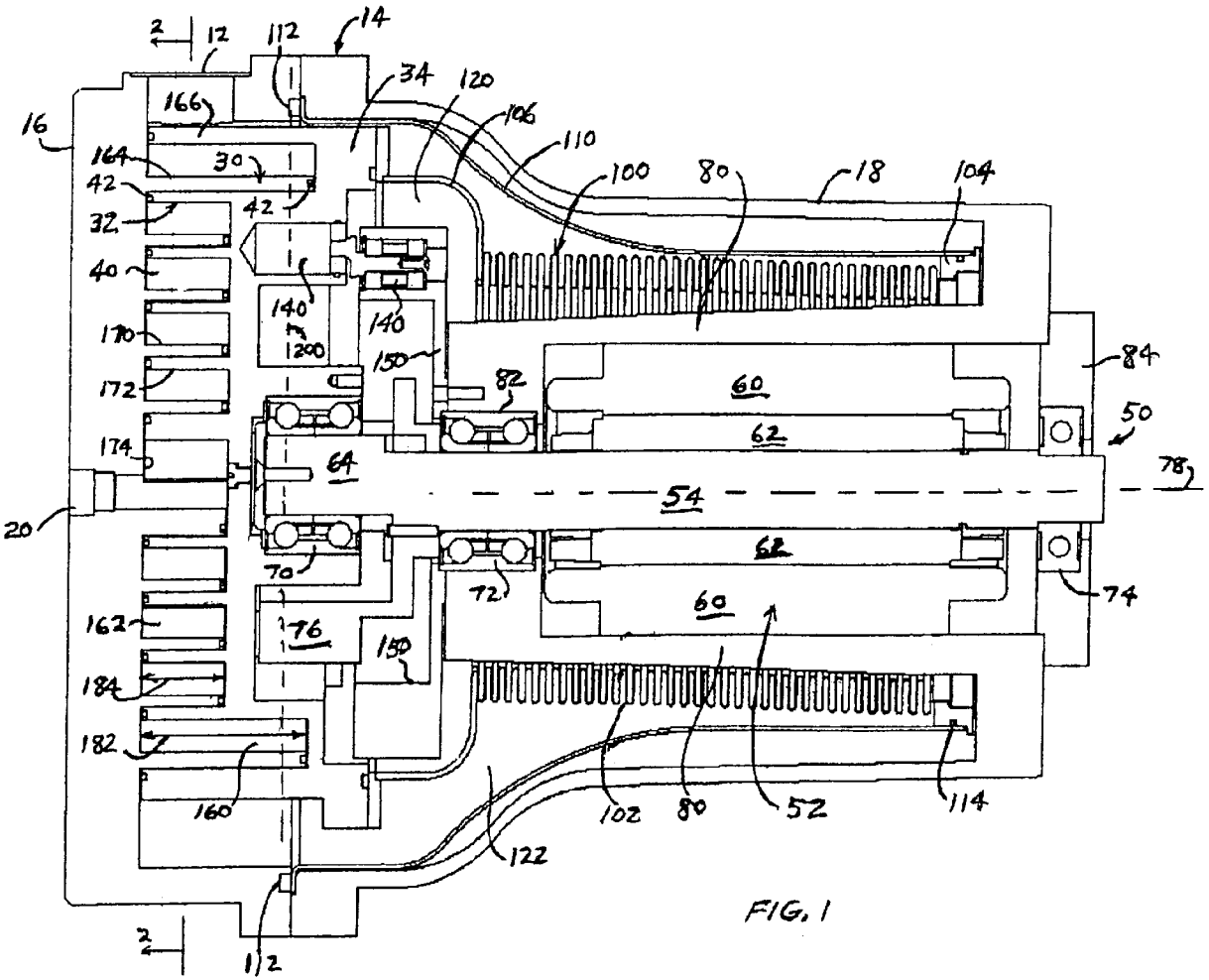
FIG. 1 is a schematic, cross-sectional diagram of a scroll-type vacuum pumping apparatus in accordance with an embodiment of the invention.

A scroll-type vacuum pump, or scroll pump, in accordance with an embodiment of the invention is shown in FIGS. 1–4. Like elements in FIGS. 1–4 have the same reference numerals. A single-ended vacuum pump is shown. A gas, typically air, is evacuated from a vacuum chamber or other equipment (not shown) connected to an inlet 12 of the pump. A pump housing 14 includes a stationary scroll plate 16 and a frame 18. The pump further includes an outlet 20 for exhaust of the gas being pumped.

Figure 2:
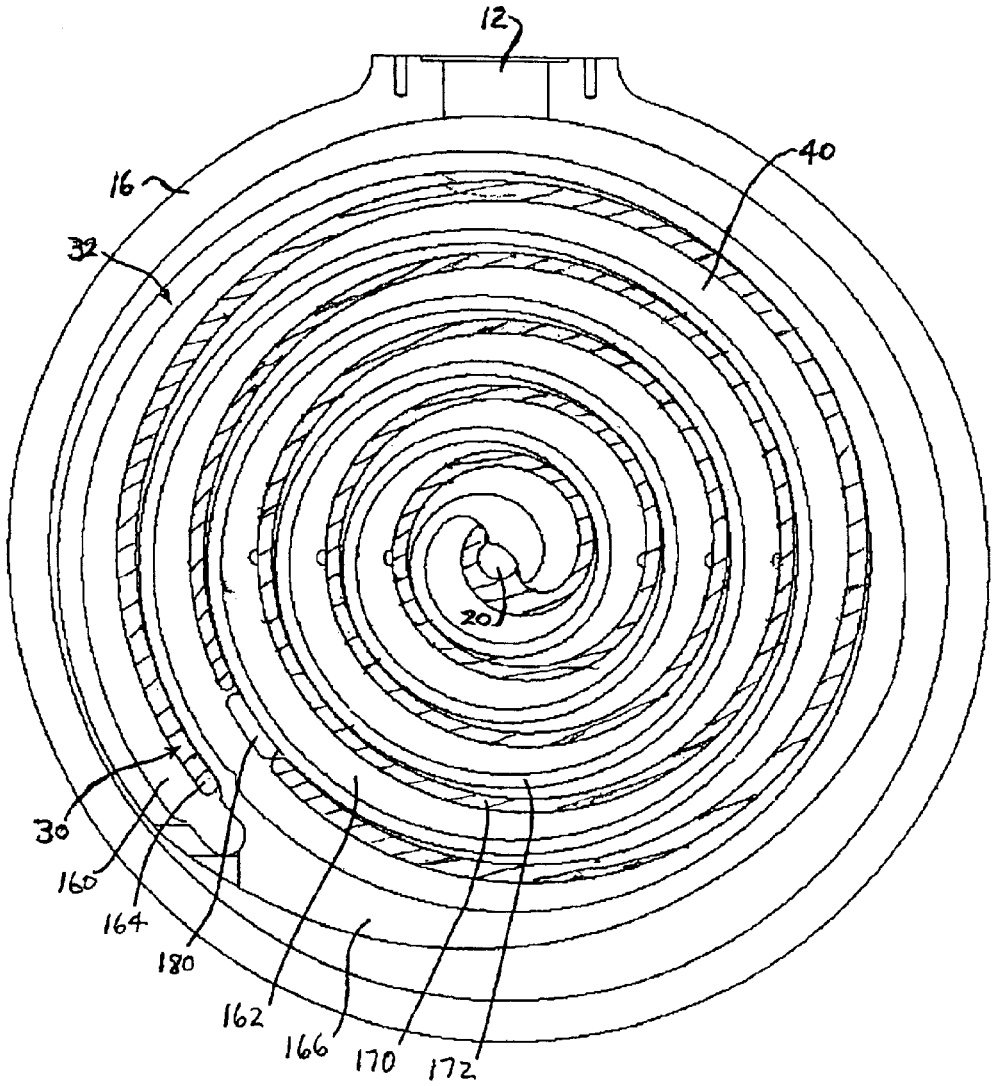
FIG. 2 is a schematic, cross-sectional diagram of the scroll-type vacuum pumping apparatus, taken along the line 2—2 of FIG. 1.

The scroll pump includes a set of intermeshed, spiral-shaped scroll blades. Referring to FIGS. 1 and 2, a scroll set includes a stationary scroll blade 30 extending from stationary scroll plate 16 and an orbiting scroll blade 32 extending from an orbiting scroll plate 34. Scroll blades 30 and 32 are preferably formed integrally with scroll plates 16 and 34, respectively, to facilitate thermal transfer and to increase the mechanical rigidity and durability of the pump. Scroll blade 30 and scroll plate 16 constitute a stationary scroll element, and scroll blade 32 and scroll plate 34 constitute an orbiting scroll element. Scroll blades 30 and 32 extend axially toward each other and are intermeshed together to form interblade pockets 40. Tip seals 42 located in grooves at the tips of the scroll blades provide sealing between the scroll elements. Orbiting motion of scroll blade 32 relative to scroll blade 30 produces a scroll-type pumping action of the gas entering the interblade pockets 40 between the scroll blades.

A drive mechanism 50 for the scroll pump includes a motor 52 coupled through a crankshaft 54 to orbiting scroll plate 34. Motor 52 includes a stator 60 and a rotor 62, which is affixed to crankshaft 54. An end 64 of crankshaft 54 has an eccentric configuration with respect to the main part of crankshaft 54 and is coupled to orbiting scroll plate 34 through an orbiting bearing 70. Crankshaft 54 is coupled to pump housing 14 through a main bearing 72 and a rear bearing 74. Crankshaft 54 rotates in bearings 72 and 74 about an axis of rotation 78. The eccentric configuration of crankshaft end 64 produces orbiting motion of scroll blade 32 relative to scroll blade 30, thereby pumping gas from inlet 12 to outlet 20.

A counterweight assembly connected to crankshaft 54 provides balanced operation of the vacuum pump when motor 52 is energized. In some embodiments, the counterweight assembly includes a single counterweight 76 connected to crankshaft 54. In other embodiments, the counterweight assembly includes at least two counterweights connected to crankshaft 54.

The frame 18 includes a reentrant center hub 80 which extends inwardly toward scroll blades 30 and 32 and which defines a cavity for receiving motor 52 and crankshaft 54. Center hub 80 defines a bore 82 for mounting main bearing 72. An end plate 84 covers the cavity defined by center hub 80 and serves as a mounting element for rear bearing 74.

The scroll pump further includes a bellows assembly 100 coupled between a first stationary component of the vacuum pump and the orbiting scroll plate 34 so as to isolate a first volume inside bellows assembly 100 and a second volume outside bellows assembly 100. One end of bellows assembly 100 is free to rotate during motion of the orbiting scroll blade 32 relative to the stationary scroll blade 30. As a result, the bellows assembly 100 does not synchronize the scroll blades and is not subjected to significant torsional stress during operation.

In the illustrated embodiment, bellows assembly 100 includes a bellows 102, a first flange 104 sealed to a first end of bellows 102 and a second flange 106 sealed to a second end of bellows 102. Flange 104 may be in the form of a ring that is rotatably mounted on center hub 80. Flange 106 may have a bell shape or a flared shape for fixed attachment to orbiting scroll plate 34.

The scroll pump may further include an optional bellows can 110 coupled between housing 14 and first flange 104. Bellows can 110 may have a tubular shape of variable diameter. One end of bellows can 110 may be secured between frame 18 and stationary scroll plate 16 and may be sealed by an elastomer ring 112. The other end of bellows can 110 may be rotatably coupled to the first flange 104 and sealed thereto with an elastomer ring 114. Thus, flange 104 is free to rotate between bellows can 110 and center hub 80. Bellows can 110 relaxes the requirement for frame 18 to be hermetically sealed.

Bellows assembly 100 is coupled between center hub 80 (the first stationary component) and orbiting scroll plate 34. In the embodiment of FIGS. 1–4, bellows assembly 100 has a fixed connection to orbiting scroll plate 34 and a rotatable connection to bellows can 110. Bellows assembly 100 provides isolation between a first volume 120 inside bellows assembly 100 and a second volume 122 outside bellows assembly 100. First volume 120 may be in gas communication with the external environment, typically at atmospheric pressure, and second volume 122 may be at or near the vacuum pressure of pump inlet 12.

The scroll pump further includes a synchronization mechanism coupled between the orbiting scroll plate 34 and a second stationary component of the vacuum pump. In the embodiment of FIGS. 1–4, the synchronization mechanism includes a set of three synchronization cranks, each coupled between orbiting scroll plate 34 and a second stationary component of the vacuum pump. In FIG. 1, a synchronization crank 140 is shown. Synchronization crank 140 and two additional synchronization cranks (not shown) are equally spaced from axis 78 and are equally spaced with respect to each other. In the embodiment of FIGS. 1–4, a mounting plate 150 is secured to center hub 80, and the stationary ends of the synchronization cranks are connected to mounting plate 150 (the second stationary component). The synchronization cranks may be of standard configuration as known in the scroll pump art.

In the embodiment of FIGS. 1–4, the scroll set includes a first pumping stage 160 and a second pumping stage 162 connected in series between inlet 12 and outlet 20. First pumping stage 160 includes first stage stationary blade 164 and first stage orbiting blade 166. Second pumping stage 162 includes a second stage stationary blade 170 and second stage orbiting blade 172. First stage stationary blade 164 and second stage stationary blade 170 together constitute stationary scroll blade 30. First stage orbiting blade 166 and second stage orbiting blade 172 together constitute orbiting scroll blade 32.

As shown in FIG. 1, first stage orbiting blade 166 and second stage orbiting blade 172 extend from a first side of orbiting scroll plate 34, and crankshaft 54 is coupled via orbiting bearing 70 to a second side of orbiting scroll plate 34. First stage stationary blade 164 and second stage stationary blade 170 extend from a common plane 174 of stationary scroll plate 16. The configuration of FIGS. 1–4 constitutes a single-sided, two-stage scroll pump. The first pumping stage 160 and the second pumping stage 162 are connected in series between inlet 12 and outlet 20, as shown in FIG. 4.

Figure 3:
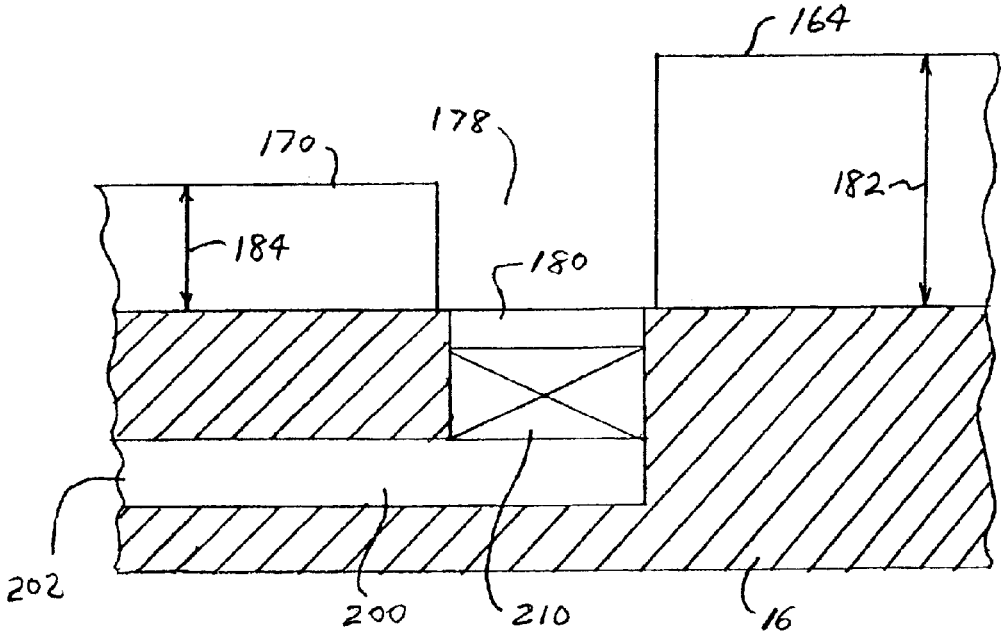
FIG. 3 is a schematic, partial cross-sectional diagram of the stationary scroll element.
Figure 4:
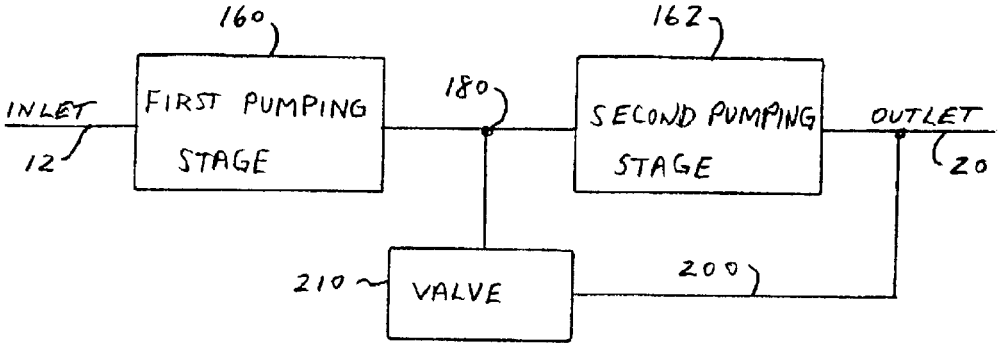
FIG. 4 is a schematic block diagram of the vacuum pumping apparatus.

As best illustrated in FIG. 3, first stage stationary blade 164 and second stage stationary blade 170 are separated by a gap 178. In one embodiment, first stage stationary blade 164 is spaced from second stage stationary blade 170 by about 0.9 inch. First stage orbiting blade 166 and second stage orbiting blade 172 may be connected together to form a continuous orbiting scroll blade.

As further illustrated in FIGS. 1 and 3, first stage stationary blade 164 and first stage orbiting blade 166 have a first axial depth 182, and second stage stationary blade 170 and second stage orbiting blade 172 have a second axial depth 184. In the embodiment of FIGS. 1–4, the first axial depth 182 is greater than the second axial depth 184 to achieve efficient pumping operation.

As shown in FIGS. 2 and 3, an interstage relief port 180 is located between first stage stationary blade 164 and second stage stationary blade 170. Relief port 180 is connected through a relief passage 200 in stationary scroll plate 16 to an exhaust 202. In one embodiment, relief passage 200 is connected to outlet 20, as shown in FIG. 4.

A valve 210 is positioned in relief passage 200 to control the flow of gas from relief port 180 to exhaust 202. As shown in FIG. 4, relief port 180 is connected through passage 200 to outlet 20 when valve 210 is open, thereby bypassing second pumping stage 162. Valve 210 may be of the type that is open to permit gas flow in the absence of a pressure differential and is closed to prevent gas flow in the presence of a pressure differential. In the embodiment of FIG. 3, valve 210 is selected to open when the pressure at relief port 180 is approximately equal to or greater than the pressure at exhaust 202, typically atmospheric pressure, and to close when the pressure at relief port 180 is lower than the pressure at exhaust 202. A commercially available poppet valve may be utilized, for example.

As shown in FIGS. 2 and 3, relief port 180 may be located between an end of first stage stationary blade 164 and an end of second stage stationary blade 170. This geometry permits relief port 180 to have a relatively large area, thereby permitting a relatively large gas flow through relief passage 200 when valve 210 is open. In one specific, non-limiting embodiment, relief port 180 has dimensions of 0.21 inch by 0.83 inch.

In operation, the configuration including relief port 180, relief passage 200 and valve 210 achieve power saving during initial vacuum pumping of a vacuum vessel. If the initial pressure at inlet 12 is at or near atmospheric pressure, gas is compressed by first pumping stage 160 thereby producing a pressure at relief portion 180 above atmospheric pressure. The power required to operate second pumping stage 162 is wasted under these conditions. When the pressure at relief port 180 is at or above atmospheric pressure, valve 210 opens and second pumping stage 162 is bypassed (FIG. 4). As a result, power input to the pump is reduced. As the pressure of the vacuum vessel is gradually reduced by the vacuum pump, the pressure at relief port 180 also decreases. In typical operation, when the pressure at inlet 12 is about 0.5 atmosphere, the pressure at relief port 180 decreases below atmospheric pressure and valve 210 closes. After valve 210 closes, second pumping stage 162 begins pumping gas and further reduces the pressure at inlet 12.

Having thus described the inventive concepts and a number of exemplary embodiments, it will be apparent to those skilled in the art that the invention may be implemented in various ways, and that modifications and improvements will readily occur to such persons. Thus, the examples given are not intended to be limiting, and are provided by way of example only. The invention is limited only as required by the following claims and equivalents thereto.

What is claimed is:

1. Vacuum pumping apparatus comprising:

a scroll set having an inlet and an outlet, said scroll set comprising a first stationary scroll blade and a second stationary scroll blade extending from a stationary plate and separated by a gap, and an orbiting scroll blade extending from an orbiting plate, wherein said first and second stationary scroll blades are intermeshed with said orbiting scroll blade to define one or more interblade pockets;

a relief port in the gap between the first and second stationary scroll blades and coupled through a relief passage to an exhaust;

a relief valve in the relief passage; and a drive mechanism operatively coupled to said orbiting plate for producing orbiting motion of said orbiting scroll blade relative to said first and second stationary scroll blades so as to cause the one or more interblade pockets to move toward the outlet.

2. Vacuum pumping apparatus as defined in claim 1, wherein the drive mechanism includes a motor having an axis of rotation, wherein the first stationary scroll blade has a first axial depth and the second stationary scroll blade has a second axial depth, and wherein the first axial depth is greater than the second axial depth.

3. Vacuum pumping apparatus as defined in claim 2, wherein the first stationary scroll blade defines a first pumping stage, wherein the second stationary scroll blade defines a second pumping stage, and wherein the first and second pumping stages are coupled in series between the inlet and the outlet.

4. Vacuum pumping apparatus as defined in claim 1, wherein the relief valve is configured to open when the pressure at the relief port exceeds the pressure at the relief port exhaust.

5. Vacuum pumping apparatus as defined in claim 1, wherein the relief port is aligned with ends of the first and second stationary scroll blades.

6. Vacuum pumping apparatus as defined in claim 5, wherein the relief port comprises an opening in the scroll plate.

7. Vacuum pumping apparatus as defined in claim 6, wherein the first and second stationary scroll blades extend from a common plane of the stationary plate.

8. Vacuum pumping apparatus as defined in claim 1, wherein the relief passage is coupled to said outlet.

9. A scroll vacuum pump comprising:

a scroll set having an inlet, an outlet and first and second pumping stages coupled in series between the inlet and the outlet, said scroll set comprising a first stationary scroll blade and a second stationary scroll blade extending from a stationary plate, and a first orbiting scroll blade and a second orbiting scroll blade extending from an orbiting plate, wherein the first stationary and orbiting scroll blades define the first pumping stage, wherein the second stationary and orbiting scroll blades define the second pumping stage, and wherein a gap is provided between the first and second stationary scroll blades;

a relief port in the gap between the first and second stationary scroll blades and coupled through a relief passage to the outlet;

a relief valve in the relief passage; and a drive mechanism operatively coupled to said orbiting plate for producing orbiting motion of said first and second orbiting scroll blades relative to said first and second stationary scroll blades.

* * * * *